US010010774B2

(12) United States Patent
Terada et al.

(10) Patent No.: US 10,010,774 B2
(45) Date of Patent: Jul. 3, 2018

(54) GOLF CLUB

(71) Applicant: YAMAHA CORPORATION, Hamamatsu-shi (JP)

(72) Inventors: Takahiro Terada, Hamamatsu (JP); Koji Yataka, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/417,324

(22) Filed: Jan. 27, 2017

(65) Prior Publication Data

US 2017/0216692 A1 Aug. 3, 2017

(30) Foreign Application Priority Data

Jan. 29, 2016 (JP) ..... 2016-016651

(51) Int. Cl.

| | |
|---|---|
| ***A63B 53/14*** | (2015.01) |
| ***A63B 60/46*** | (2015.01) |
| ***A63B 24/00*** | (2006.01) |
| ***A63B 53/00*** | (2015.01) |

(Continued)

(52) U.S. Cl.

CPC ..... *A63B 60/46* (2015.10); *A63B 24/0003* (2013.01); *A63B 53/00* (2013.01); *A63B 53/14* (2013.01); *A63B 60/16* (2015.10); *A63B 2071/0694* (2013.01); *A63B 2207/02* (2013.01); *A63B 2220/803* (2013.01); *A63B 2225/50* (2013.01)

(58) Field of Classification Search

CPC ..... A63B 60/46; A63B 24/0003; A63B 53/00; A63B 2225/50; A63B 2071/0694; A63B 2207/02; A63B 2220/803; A63B 53/14; A63B 60/16

See application file for complete search history.

(56) References Cited

U.S. PATENT DOCUMENTS 4,759,219 A * 7/1988 Cobb ..... A63B 69/0002 473/233
5,779,555 A * 7/1998 Nomura ..... A63B 69/3632 473/223

(Continued)

FOREIGN PATENT DOCUMENTS

JP 2011083356 A 4/2011
JP 2014144198 A 8/2014

(Continued)

OTHER PUBLICATIONS

Office Action issued in Korean Appln. No. 10-2017-0000630 dated Jan. 16, 2018. English translation provided.

*Primary Examiner* — Stephen Blau
(74) *Attorney, Agent, or Firm* — Rossi, Kimms & McDowell LLP

(57) ABSTRACT

A golf club has within the grip a main device, a connector, a wireless module, an antenna, a light emitting element, and an optical fiber. The main device is a device that includes a sensor such as a motion sensor, a circuit such as a CPU, and a battery. The light emitting element is an indicating means that emits light in accordance with the state of a component mounted in the golf club. The light emitted by the light emitting element is guided to the grip end by the optical fiber and emitted to the outside of the grip via the grip end.

7 Claims, 7 Drawing Sheets

(51) Int. Cl.
*A63B 60/16* (2015.01)
*A63B 71/06* (2006.01)

(56) References Cited

U.S. PATENT DOCUMENTS 5,952,921 A * 9/1999 Donnelly ..... G08B 13/1427 340/568.6
6,649,905 B2 * 11/2003 Grenlund ..... A63B 71/0619 250/227.14
7,143,639 B2 * 12/2006 Gobush ..... A63B 24/0003 73/65.03
7,419,438 B2 * 9/2008 Koiwai ..... A63B 69/3685 473/221
7,837,575 B2 * 11/2010 Lee ..... A63B 24/0003 473/131
8,226,495 B2 7/2012 Savarese et al.
8,506,425 B2 * 8/2013 Wright ..... A63B 69/3632 473/131
8,613,676 B2 * 12/2013 Bentley ..... A63B 21/4035 473/219
8,641,546 B2 * 2/2014 Rauchholz ..... A63B 67/02 463/31
8,657,707 B2 * 2/2014 Ueda ..... A61B 5/6895 473/212
8,668,595 B2 * 3/2014 Boyd ..... A63B 24/0003 473/223
RE44,862 E * 4/2014 Wright ..... A63B 57/00 473/131
8,715,096 B2 * 5/2014 Cherbini ..... G09B 19/0038 473/131
8,926,444 B2 * 1/2015 Kato ..... A63B 69/3632 473/202
8,956,238 B2 * 2/2015 Boyd ..... A63B 24/0003 473/223
9,375,624 B2 * 6/2016 Boyd ..... A63B 69/36
9,378,411 B2 * 6/2016 Ueda ..... G06K 9/0053
9,452,331 B2 * 9/2016 Okazaki ..... G01B 7/001
9,630,066 B2 * 4/2017 Kato ..... A63B 53/02
2004/0204257 A1 * 10/2004 Boscha ..... A63B 24/0003 473/131
2005/0020369 A1 * 1/2005 Davis ..... A63B 69/3614 473/131
2005/0054457 A1 * 3/2005 Eyestone ..... A63B 15/00 473/221
2006/0029916 A1 * 2/2006 Boscha ..... A63B 24/0003 434/252
2009/0233735 A1 9/2009 Savarese et al.
2012/0249330 A1 * 10/2012 Savarese ..... A63B 71/0669 340/568.6
2016/0346657 A1 * 12/2016 Beno ..... A63B 53/00
2017/0354844 A1 * 12/2017 Nomura ..... A63B 24/0006

FOREIGN PATENT DOCUMENTS

JP 2014198097 A 10/2014
KR 1020110005247 A 1/2011

* cited by examiner

GOLF CLUB

BACKGROUND OF THE INVENTION

Field of the Invention

The present invention relates to a golf club used in a fitting service that selects a golf club suited to a golfer.

Priority is claimed on Japanese Patent Application No. 2016-16651, filed Jan. 29, 2016, the content of which is incorporated herein by reference.

Description of Related Art

Japanese Unexamined Patent Application 2014-144198 (Patent Document 1) discloses a golf club that is used in this type of fitting service. The golf club of Patent Document 1 has a sensor casing in which a sensor, an analog/digital (A/D) converter, a central processing unit (CPU), a wireless interface, and a wireless antenna are housed, and a battery portion that houses a battery. The battery portion is disposed in the grip, and the sensor casing is disposed projecting from the grip end. When a golfer who receives the fitting service (herinbelow simply called a golfer) swings the golf club of Patent Document 1, the sensor in the golf club detects the motion of the golfer during the swing. The golf club of Patent Document 1 transmits the detection result of the sensor by wireless communication to a computer that functions as a data analysis device. The computer analyzes the swing from the sensor detection result that has been received, and displays the result. The fitting service provider (hereinbelow called the fitter), by referring to the swing analysis result obtained in this way, can propose a golf club suited to the golfer.

However, with a fitting service that uses the golf club of Patent Document 1, the fitter and golfer cannot ascertain from the golf club itself the state of the wireless link between the golf club and the computer and the state of a component mounted in the golf club such as the residual battery capacity.

In addition, in the golf club of Patent Document 1, since the sensor casing projects from the grip end, compared to a golf club used for playing golf, the center of gravity of the golf club shifts to the grip end side by an amount corresponding to the projection of the sensor casing (in other words, to the side of the golfer grasping the golf club). For this reason, there is a risk of the golf club of Patent Document 1 imparting a sense of incongruity to the golfer during the swing. Also, since the golf club of Patent Document 1 differs in appearance from a golf club used for playing golf due to the sensor casing projecting from the grip end, there is a risk of imparting a sense of visual incongruity to the golfer.

Moreover, since the sensor casing in the golf club of Patent Document 1 projects from the grip end, there is a risk of impact to the sensor casing, and so there is a high possibility of the sensor housed therein being damaged.

The present invention was achieved in view of the above circumstances, and has as its main object to enable a fitter that provides a fitting service and a golfer who receives the fitting service to be able to ascertain the state of a component mounted in the golf club used in the fitting service.

SUMMARY OF THE INVENTION

According to the present invention is obtained a golf club that is used in a fitting service that selects a golf club suited to a golfer and that has a shaft and a grip, having: components mounted in the interior of the grip, including at least a sensor that detects motion of the golfer, a wireless module that modulates a signal output by the sensor, and an antenna that is connected to the wireless module; and a light emitting element that is mounted in the interior of the grip and that indicates the state of the components, in which the antenna is provided at a position nearer to the grip end of the grip than the light emitting element, and an optical fiber is provided that propagates the emission light emitted from the light emitting element to the outside of the grip end.

Moreover, according to the present invention is obtained a motion detection device that is provided in a grip and that detects motion of a player, having: components mounted in the interior of the grip, including at least a sensor that detects motion of the player, a wireless module that modulates a signal output by the sensor, and an antenna that is connected to the wireless module; and a light emitting element that is mounted in the interior of the grip and that indicates the state of the components, in which the antenna is provided at a position nearer to the grip end of the grip than the light emitting element, and an optical fiber is provided that propagates the emission light emitted from the light emitting element to the outside of the grip end.

In the golf club of this invention, the state of a component mounted in the golf club is indicated by an indicating means. For this reason, the fitter that provides the fitting service and a golfer that receives the fitting service can ascertain from the golf club itself the state of a component mounted in the golf club.

DETAILED DESCRIPTION OF THE INVENTION

Figure 1:
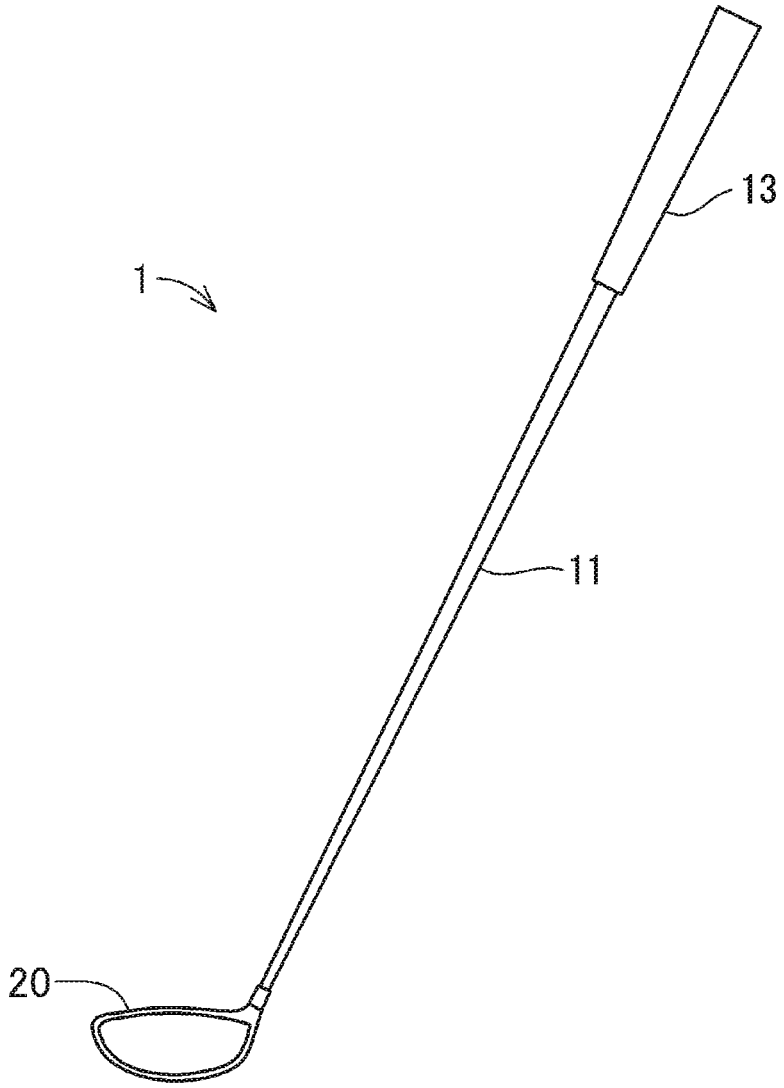
FIG. 1 is a front view showing the golf club for a fitting service according to one embodiment of the present invention.

An embodiment of this invention will be described below referring to the drawings.

Referring to FIG. 1, a golf club 1 of the present embodiment is one that is used in a fitting service that selects a golf club suited to a golfer. In the fitting service, the golfer who receives the fitting service takes a swing using the golf club 1 of the present embodiment. When the golfer swings the golf club 1, the motion of the golfer is detected by the golf club 1, and the result is transmitted to a computer that functions as a data analyzer. The computer analyzes the motion of the golfer from that detection result and displays the analysis result. The fitter who provides the fitting service, by referring to the analysis result by the computer, is able to select and propose a golf club to the golfer.

The shaft 11 of the golf club 1 is a hollow rod-like member in which carbon material is processed into a cylindrical shape. A head 20 is provided at the front end of the shaft 11. The head 20 is one that is identical to that of an ordinary golf club used for playing golf.

Figure 2:
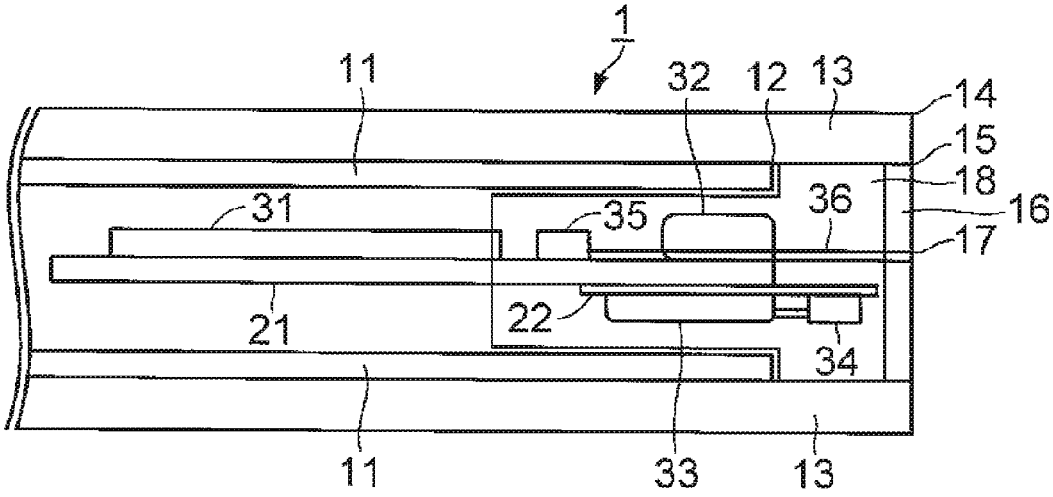
FIG. 2 is a perspective side view showing the constitution in the vicinity of the grip end of the golf club for a fitting service according to one embodiment of the present invention.
Figure 3:
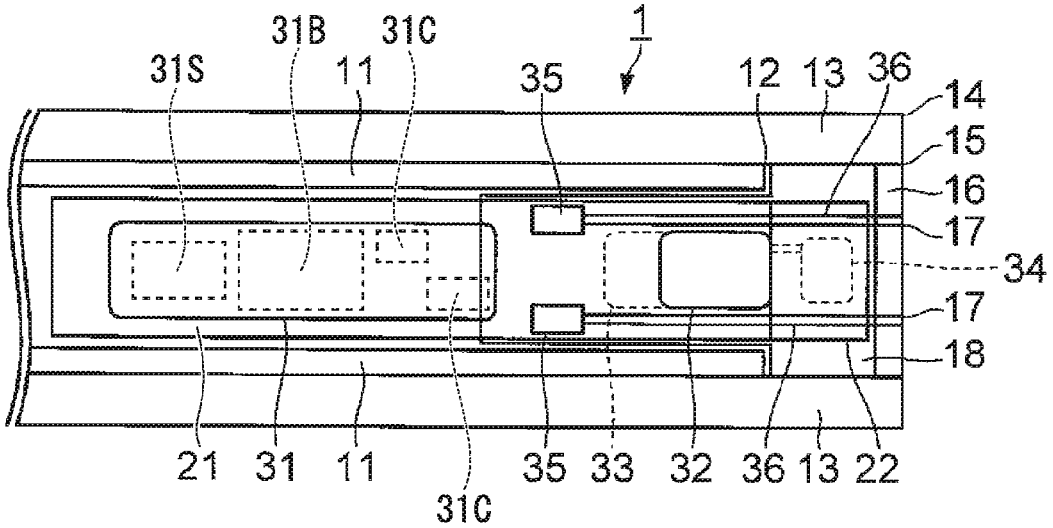
FIG. 3 is a perspective front view showing the constitution in the vicinity of the grip end of the golf club for a fitting service according to one embodiment of the present invention.

FIG. 2 and FIG. 3 are a perspective side view and a front view, respectively, of the constitution in the vicinity of a grip end 14 of the golf club 1 according to the embodiment of this invention.

The rear end of the shaft 11 is inserted into a hollow tube-like grip 13. The material forming the grip 13 is a material having an electrical insulating property such as rubber or resin. The outer surface of the portion of the shaft 11 that is inserted in the grip 13 is in contact with the inner surface of the grip 13. Hereinbelow, the direction heading from the middle of the golf club 1 to the head is called forward, while the direction heading from the middle of the golf club 1 to the grip 13 is called rearward. The rear end of the shaft 11 inserted in the grip 13 (hereinbelow called the shaft end 12) is positioned forward of the grip end 14.

A disk-shaped cap 16 that plugs the opening portion 15 of the grip end 14 is mounted in the grip end 14. A grip end holder 18 is provided within the grip 13 in the vicinity of the grip end 14. The grip end holder 18 is a cylindrical member that appears to couple in the lengthwise direction two cylindrical members having different outer diameters. In greater detail, the grip end holder 18 is a cylindrical member that extends along the inner surface of the grip 13 from the cap 16 mounted in the grip end 14 to the shaft end 12 and, after decreasing in diameter such that the side surface bends back and forth in a stepped manner at the shaft end 12 portion, extends forward from the shaft end 12 along the inner surface of the shaft 11. The material that forms the grip end holder 18 is a material having an electrical insulating property such as rubber or resin.

The golf club 1 has a first internal substrate 21, a second internal substrate 22, a main device 31, a connector 32, a wireless module 33, an antenna 34, a light emitting element 35, and an optical fiber 36 in the grip 13. FIG. 2 is a drawing viewing the inside of the grip 13 from the side surface side of the plate-like first internal substrate 21, and FIG. 3 is a drawing of the inside of the grip 13 from the upper side of the first internal substrate 21.

The first internal substrate 21 is inside the grip 13 and moreover disposed in a region inside the shaft 11 (hereinbelow called the inside region of the shaft 11), and is supported by the grip end holder 18. The connector 32, the light emitting element 35, and the main device 31 are provided in that order on one surface of the first internal substrate 21, heading forward from the shaft end 12.

The main device 31 is a device that includes a sensor 31S, a battery 31B, and various circuits 31C. The sensor 31S is a detection means for detecting motion of the golfer from a swing using the golf club 1. The sensor 31S is a motion sensor that includes for example an accelerometer capable of detecting acceleration in three axis directions, an angular velocity sensor capable of detecting angular velocity about three axes, and a magnetic sensor capable of detecting terrestrial magnetism in three axis directions. The battery 31B is a power supply for supplying electrical power to each element of the golf club 1. The battery 31B is for example a rechargeable secondary battery such as a lithium ion battery. An A/D converter for converting the output signal of the sensor 31S to a digital signal and a CPU that functions as the control center of the golf club 1 are included in the various circuits 31C of the main device 31. Also, a strain sensor for measuring deflection of the shaft 11 may be connected to the main device 31.

The connector 32 is an interface for performing transmission and reception of data and electric power to and from an external device. The connector 32 is connected to the main device 31 via the first internal substrate 21. When the cap 16 is removed, the connector 32 is exposed via the opening 15 of the grip end 14 in the grip 13. The connector 32 is for example a female connector of the Universal Serial Bus (USB) Type-C standard. For example, when a male connector corresponding to the connector 32 is plugged into the connector 32, the golf plug 1 begins charging of the battery 31B by means of plug-and-play technology.

The second internal substrate 22 is stacked on the opposite surface of the first internal substrate 21 with respect to the surface on which the connector 32 and the like are provided, in the vicinity of the shaft end 12. The second internal substrate 22 is supported by the grip end holder 18 and the first internal substrate 21. A portion of the second internal substrate 22 is inside the grip 13 and disposed in a region outside the shaft 11 (hereinbelow called the outside region of the shaft 11). The wireless module 33 and the antenna 34 connected to the wireless module 33 are provided on the opposite surface of the second internal substrate 22 with respect to the first internal substrate 21.

The wireless module 33 is disposed in the inside region portion of the shaft 11 on the second internal substrate 22. The wireless module 33 is disposed exactly on the opposite side of the connector 32, sandwiching the first internal substrate 21 and the second internal substrate 22 therebetween. The wireless module 33 is a wireless communication means that modulates the signal output by the main device 31 and, via a wireless link, transmits the modulated signal to the computer, and also demodulates a signal received from the computer via the wireless link and outputs the demodulated signal to the main device 31. The signal that represents the detection result of the sensor 31S is included in the signal that the wireless module 33 transmits.

The antenna 34 is disposed in the outside region portion of the shaft 11 on the second internal substrate 22. That is, the radio wave radiating surface of the antenna 34 is surrounded by the grip 13 and the grip end holder 18, which have insulating properties, without being blocked by the shaft 11, which is electrically conductive. Since the radio waves emitted from the radio wave radiating surface of the antenna 34 are not blocked by the shaft 11, which is electrically conductive, in the golf club 1, the wireless module 33 is able to perform wireless communication without trouble. Also, since the antenna 34 is disposed on the opposite side of the connector 32, sandwiching the first internal substrate 21 and the second internal substrate 22 therebetween, there is no obstruction to plugging in a connector corresponding to the connector 32.

Two light emitting elements 35 are installed on the first internal substrate 21, between the connector 32 and the main device 31. Each of the light emitting elements 35 is for example a light emitting diode (LED) that emits visible light. The light emitting elements 35 are electrically connected to the main device 31.

The optical fiber 36 is provided between each light emitting element 35 and the cap 16 attached to the grip end 14. The optical fiber 36 is affixed to the first internal substrate 21 so as to bypass the connector 32. The light emitting element 35-side end of the optical fiber 36 is disposed in contiguity with the light emitting surface of the light emitting element 35, while the grip end 14-side end of the optical fiber 36 is accommodated in a through hole 17 of the cap 16. Light of the light emitting element 35 that is incident from the light emitting element 35-side end of the optical fiber 36 propagates through the optical fiber 36 to be emitted to the outside of the golf club 1 from the grip end 14-side end of the optical fiber 36.

The light emitting element 35 is an indicating means for emitting light in accordance with the state of a component mounted in the golf club 1 (hereinbelow referred to as the state of the golf club 1), and indicating the state of a component mounted in the golf club 1 to the fitter or golfer. The optical fiber 36 is an emitting means for guiding the output of the indicating means in the grip 13 (specifically, the light emitted by the light emitting element 35) to the grip end 14 and emitting the light to the outside of the grip 13 via the grip end 14.

Since the light emitted by the light emitting element 35 is emitted to the outside of the golf club 1 via the optical fiber 36, the fitter or golfer is able to visually confirm the light of the light emitting element 35 by looking at the grip end 14. For this reason, the fitter or golfer is able to become aware of the state of a component mounted in the golf club 1 that is used in the fitting service by the emitted light of the light emitting element 35.

Examples of the state of a component mounted in the golf club 1 that the light emitting element 35 indicates include the charge state of the battery 31B, the wireless connection state with the computer, and a disconnection state between the elements of the golf club 1 or within the circuit 31C. The fitter or golfer, by looking at the grip end 14 at the start of the fitting service or before or after the swing, can confirm the state of this kind of golf club 1. The states of the golf club 1 indicated by the light emitting element 35 are not limited thereto.

For example, the following steps may be performed to indicate the charge state of the battery 31B.

Figure 4:
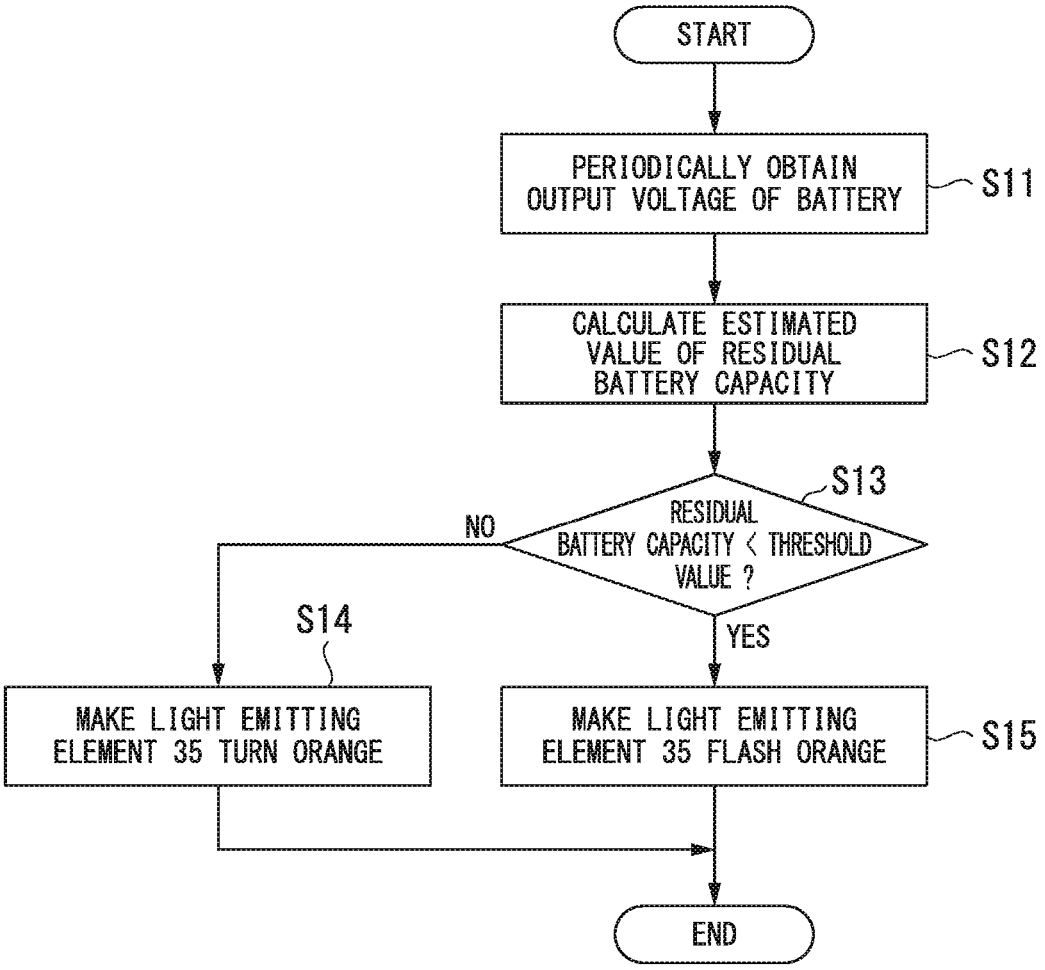
FIG. 4 is a flowchart showing the operation of the golf club according to one embodiment of the present invention indicating the charge state of the battery.

Referring to FIG. 4, first, the CPU periodically obtains the output voltage of the battery 31B in accordance with a clock or timer (S11). Next, the CPU calculates an estimated value of the residual battery capacity on the basis of the voltage value of the output voltage of the battery 31B that was obtained (S12). For the calculation of the estimated value of the residual battery capacity, a table or function relating the voltage value of the battery and residual battery capacity should be used. Next, the CPU determines whether or not the calculated residual battery capacity is below a predetermined threshold value (S13). The CPU detects the charge state of the battery 31B in this way.

Next, the CPU makes the light emitting element 35 turn orange when the residual capacity of the battery 31B is equal to or greater than the threshold value (S14) and makes the light emitting element 35 flash orange when the residual battery capacity is lower than the threshold value (S15) to thereby indicate the charge state of the battery 31B. If the light emitting element 35 is thus made to emit light, it is possible to urge charging of the battery by notifying the fitter or golfer that the residual battery capacity is running low. A fitter or golfer who has confirmed the light indicating that the residual battery capacity is low (in this example, orange flashing) should remove the cap 16 of the golf club 1 and plug a cable with a connector connected to an external power source into the connector 32 to charge the battery 31B.

Also, the following steps may be performed to indicate the wireless connection state.

Figure 5:
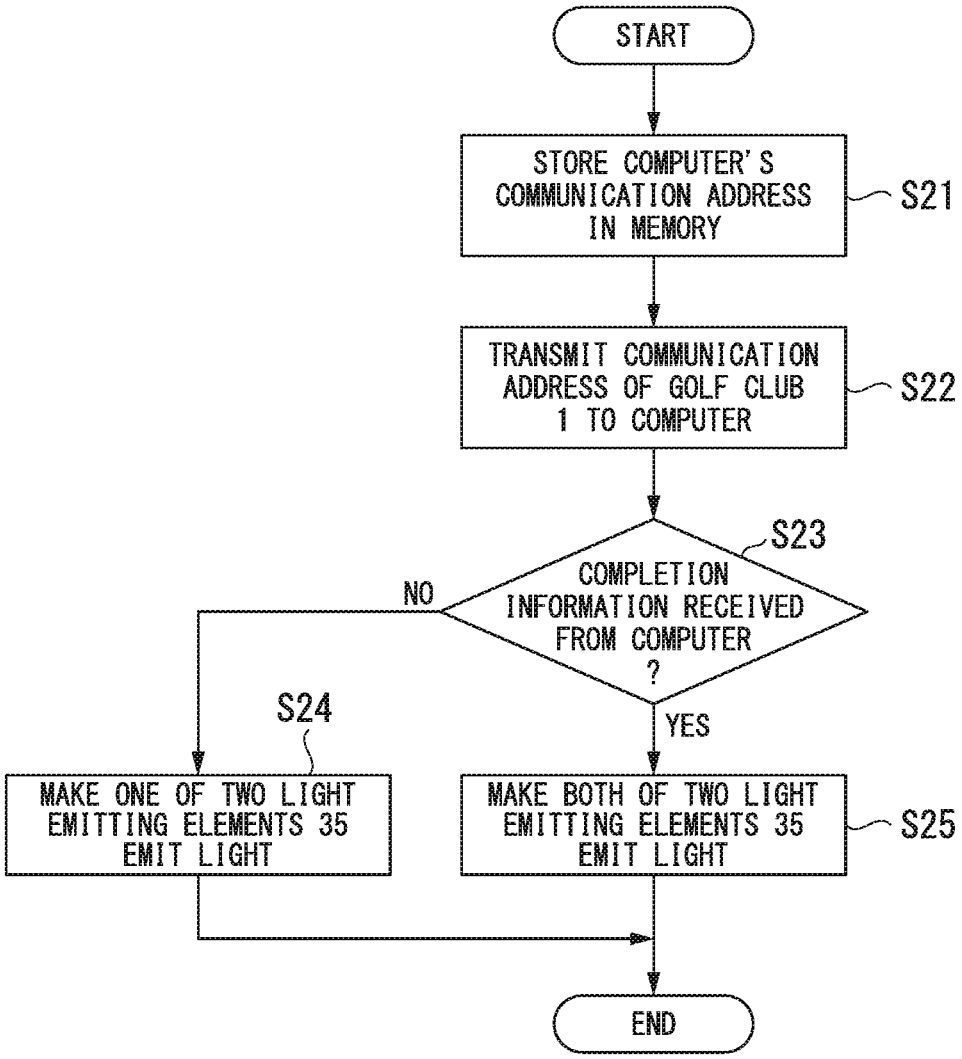
FIG. 5 is a flowchart showing the operation of the golf club according to one embodiment of the present invention indicating the wireless connection state with a computer.

Referring to FIG. 5, first, the computer that processes data transmitted from the golf club 1 broadcasts information including its own communication address (specifically, the MAC address) in response to an operation by the fitter (or periodically). The CPU of the golf club 1, upon receiving that information via the antenna 34 and the wireless module 33, stores the computer's communication address in a storage means (S21). Then, the CPU transmits information including its own communication address (specifically, the MAC address) to the communication address of the computer (S22). The computer, upon receiving the information, stores the communication address of the golf club 1 in a storage means. Thus a wireless link is established between the computer and the golf club 1 by mutually storing the communication addresses of the communication partner. Then, the computer transmits to the golf club 1 completion information indicating that the communication address of the golf club 1 has been stored. The CPU of the golf club 1 determines whether or not it has received this completion information (S23), and when it has received this completion information recognizes that the communication link has been established. The CPU in this manner detects the wireless connection state. If the wireless link is established, since a state arises in which the communication address of the communication partner is stored in the storage means, the wireless communication state is an example of the state of a component mounted in the golf club 1.

The CPU, while a wireless link is not established, causes one of the two light emitting elements 35 to emit light (S24), and once the wireless link has been established, causes both of the two light emitting elements 35 to emit light (S25). If the light emitting element 35 is made to emit light to indicate the wireless connection state in this way, it is possible for the fitter or golfer to become aware that a wireless link has not been established. The fitter who has confirmed the light indicating that the wireless link has not been established (in this example, the light of one light emitting element 35) should redo the wireless link connection operation.

Also, the following steps may be performed to indicate a disconnection state. First, the golf club 1 is equipped with a disconnection state detection means that detects a disconnection state of wiring that is the object to be detected. The disconnection state detection means may be any one provided it is of a constitution in which the CPU can recognize the disconnection state of wiring that is the object to be detected. As one example of detecting a disconnection of wiring between the CPU and the wireless module 33, the following mode shall be considered.

Figure 6:
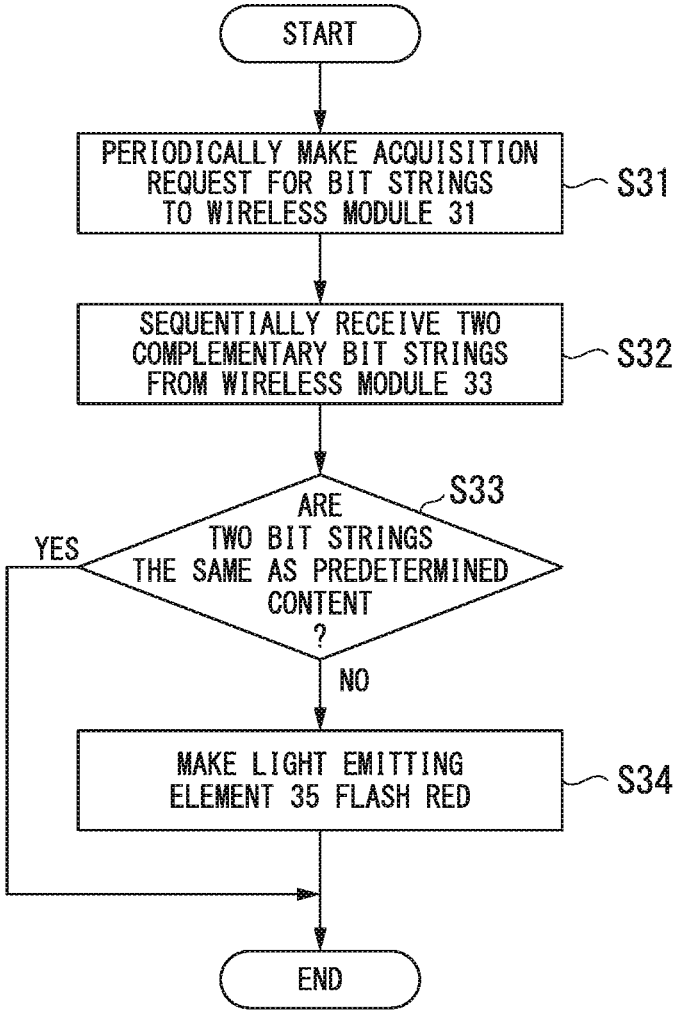
FIG. 6 is a flowchart showing the operation of the golf club according to one embodiment of the present invention indicating the disconnection state between components of the golf club.

Referring to FIG. 6, the CPU and the wireless module 33 are assumed to be connected by a plurality (for example, four) data lines. Two predetermined complementary bit strings with just as many digits as data lines (for example, "0101" and "1010") are stored in the register of the wireless module 33. The CPU periodically makes an acquisition request for these bit strings to the wireless module 33 (S31). The wireless module 33, in response to the request from the CPU, transmits the bit of the first digit via the first data line, the bit of the second digit via the second data line, the bit of the third digit via the third data line, and the bit of the fourth digit via the fourth data line. In this manner, the two bit strings are in turn transmitted, with the digits of the bit strings corresponding to the data lines (S32). The CPU determines whether or not each bit of the two bit strings received in turn from the wireless module 33 is the same as the predetermined content (S33). In the case of there being a bit that differs from the predetermined content, the CPU recognizes that there is a disconnection or an open circuit in the data line in which that bit was transmitted. When there is a disconnection or an open circuit in a data line, the voltage level of that data line comes to be fixed at one of either an H level or an L level. When the voltage level is fixed at the L level, even if the wireless module 33 outputs the bit "1" representing the H level, the CPU only obtains the bit "0" representing the L level. For this reason, the CPU can detect a disconnection state by whether or not the two complementary bit strings can be correctly received.

The CPU causes the light emitting element to flash red when it detects a disconnection or short circuit in the golf club 1, that is, when the two bit strings are not the same as the predetermined content (S34). If the light emitting element 35 is made to emit light in this way, the fitter or golfer can become aware that a disconnection or short circuit has occurred in the golf club 1 whereby the golf club 1 is not in a normal state. A fitter that has confirmed the light indicating that a disconnection or short circuit has occurred (in this example the red light), should provide the fitting service after making a replacement with a normal golf club 1.

The method of detecting the state of a component mounted in the golf club 1 (the charge state of the battery 31B, the wireless connection state, or a wiring disconnection state) is not limited to the aforementioned examples. Also, the mode of distinguishing the state of the golf club 1 by the light emitting element 35 is not limited to its illumination, flashing, illumination number, and luminescent color. For example, the state of the golf club 1 may be distinguished by the period of the flashing. Also, the combinations of the states of the golf club 1 and the light emission patterns of the light emitting element 35 (illumination, flashing, illumination number, and luminescent color) are not limited to the aforementioned examples. Also, the number of light emitting elements 35 mounted in the golf club 1 is not limited to two. The number of light emitting elements 35 may be one, and may be three or more.

As mentioned above, the golf club 1 of the present embodiment has a light emitting element 35 that emits light in accordance with the state of a component mounted in the golf club 1. Since the state of a component mounted in the golf club 1 is indicated to the fitter or the golfer by the light emitting element 35, the fitter or golfer can ascertain from the golf club 1 itself the state of the component mounted in the golf club 1.

In the present embodiment, the antenna 34 that is connected to the wireless module and that outputs radio waves is provided at a location near the grip end of the grip 13. For this reason, the golf club 1 can wirelessly transmit to the computer in a favorable manner via the antenna 34 data that should be transferred from the golf club 1. Since the antenna 34 is disposed near the grip end, the light emitting element 35 comes to be arranged at a location further removed from the grip end than the antenna 34. Therefore, by providing the optical fiber 36 between the light emitting element 35 and the grip end, the emission light of the light emitting element 35 is made to be guided to the outside of the grip end.

Also, in the golf club 1 of the present embodiment, the main device 31 including the sensor 31S, the wireless module 33, and the antenna 34 are accommodated within the grip 13, with there being no portion that projects from the grip end 14. For this reason, in the golf club 1, compared to a golf club used for playing golf, there is no shifting of the center of gravity of the golf club 1 to the grip end 14 side, and there is no change in the appearance. Accordingly, when using the golf club 1 in a fitting service, no sense of incongruity arises during the swing or visually in the golfer receiving the fitting service.

Moreover, in the golf club 1 of the present embodiment, since the sensor 31S or the like does not project from the grip end 14, the possibility of the sensor 31S being damaged is low.

First Related Art

Figure 7:
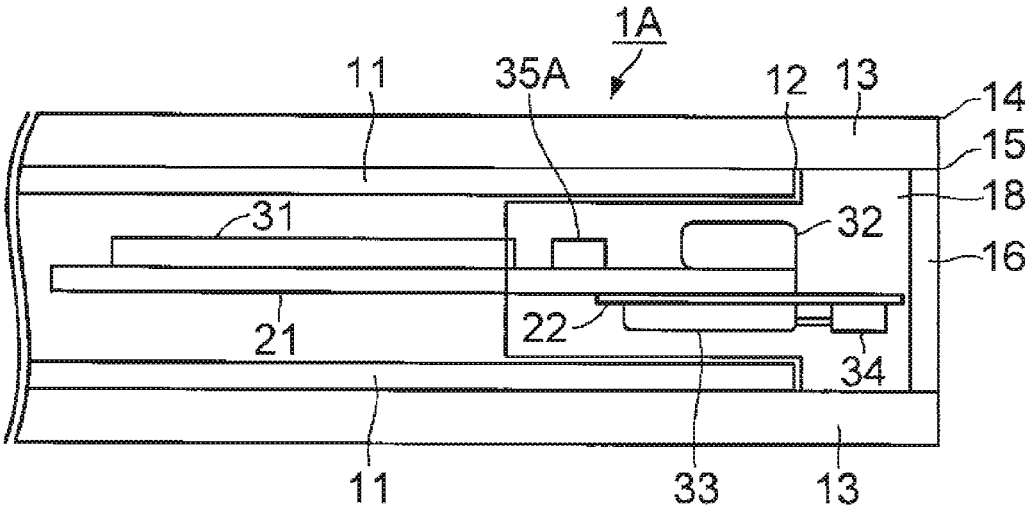
FIG. 7 is a perspective side view showing the constitution in the vicinity of the grip end of a golf club according to a first related art of the present invention.
Figure 8:
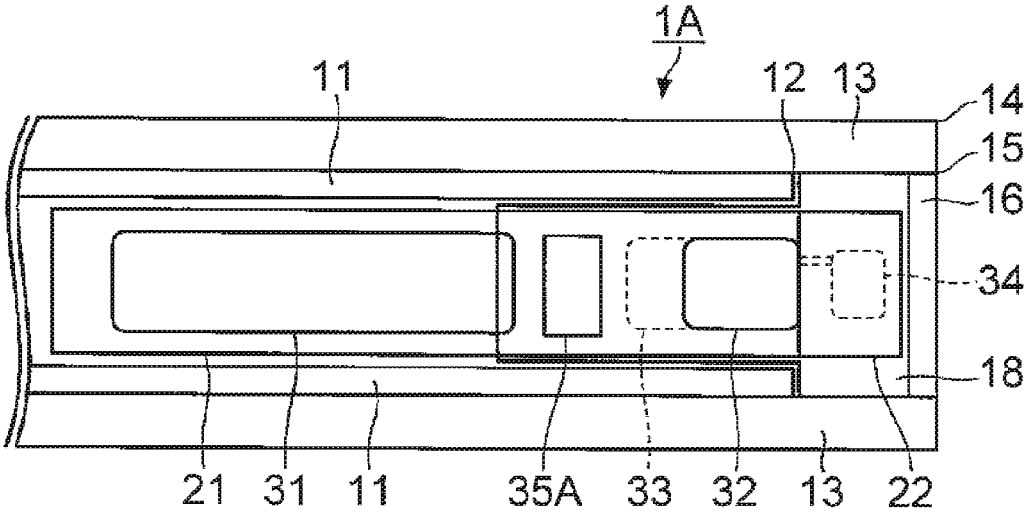
FIG. 8 is a perspective front view showing the constitution in the vicinity of the grip end of the golf club shown in FIG. 7.

FIG. 7 and FIG. 8 are a perspective side view and a front view, respectively, showing the constitution of a golf club 1A according to a first related art of this invention. The golf club 1A of this related art differs from the golf club 1 of the aforementioned embodiment on the point of having a sound emitting device 35A instead of the optical fiber 36 and the light emitting element 35.

The sound emitting device 35A is provided at a position between the main device 31 and the connector 32 on the first internal substrate 21. The sound emitting device 35A is, specifically, a speaker unit or a buzzer. The sound emitting device 35A is electrically connected to the main device 31.

The sound emitting device 35A is an indicating means for indicating with a sound to the fitter or golfer the state of a component mounted in the golf club 1A by emitting a sound in accordance with the state of the component mounted in the golf club 1A. The sound emitting device 35A emits sounds in accordance with the states of the golf club 1A under the control of the CPU. The states of the golf club 1A are the same as those of the first embodiment. For example, when the residual battery capacity has fallen below a predetermined threshold value, the CPU outputs an audio signal associated in advance with the condition of that residual battery capacity to the sound emitting device 35A, and causes the sound expressed by that audio signal to be emitted from the sound emitting device 35A. The fitter or golfer can become aware of the state of the golf club 1A by the sound that is emitted by the sound emitting device 35A. Also, by changing the frequency, timbre, melody, or sound emission period of the sound emitted by the sound emitting device 35A to match the state of the golf club 1A, it is possible to enable the fitter or golfer to distinguish between states of the golf club 1A.

As mentioned above, in the golf club 1A of the present embodiment, the state of a component mounted in the golf club 1A is indicated to the fitter or golfer by a sound emitted by the sound emitting device 35A. Also, there is no portion projecting from the grip end 14. Thereby, the same effect as the embodiment of the present invention is achieved in the first related art.

Second Related Art

Figure 9:
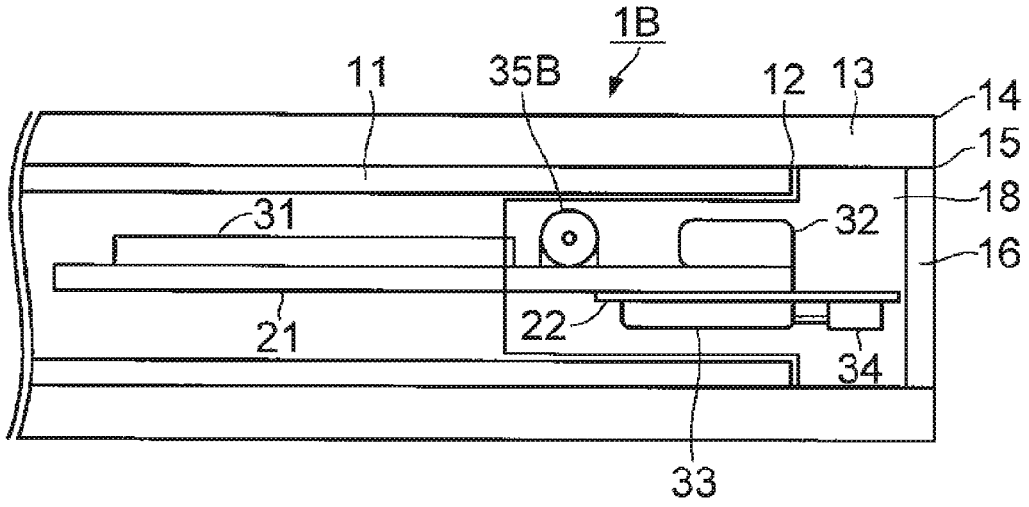
FIG. 9 is a perspective side view showing the constitution in the vicinity of the grip end of a golf club according to a second related art of the present invention.
Figure 10:
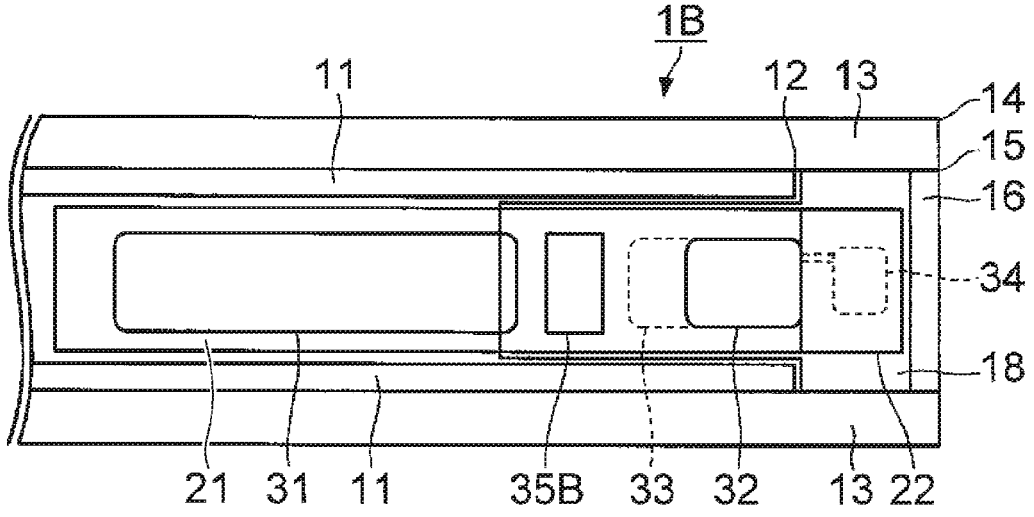
FIG. 10 is a perspective front view showing the constitution in the vicinity of the grip end of the golf club shown in FIG. 9.

FIG. 9 and FIG. 10 are a perspective side view and a front view, respectively, showing the constitution of a golf club 1B according to a second related art of this invention. The golf club 1B of this related art differs from the golf club 1 of the aforementioned embodiment of the present invention on the point of having a vibration generating device 35B instead of the optical fiber 36 and the light emitting element 35.

The vibration generating device 35B is provided at a position between the main device 31 and the connector 32 on the first internal substrate 21. The vibration generating device 35B is electrically connected to the main device 31. The vibration generating device 35B is an electrical motor that is so small and lightweight that it can be accommodated in the grip 13. The main body of the vibration generating device 35B which serves as the stator is supported by the grip 13 via the first internal substrate 21 and the grip end holder 18. A weight is coupled to the distal end of a member serving as the central axis of rotation of the rotor of the vibration generating device 35B. The weight is coupled so that the center of gravity of the weight shifts from the central axis of rotation of the rotor. When the rotor rotates, due to the centrifugal force of the weight that is being shifted from the central axis of rotation of the rotor, the entire vibration generating device 35B is swung about. Due to the swinging about of the entire vibration generating device 35B, vibration is produced, and that vibration travels to the grip 13 supporting the entire vibration generating device 35B.

The vibration generating device 35B is an indicating means for generating vibration according to the state of a component mounted in the golf club 1B and indicating the state of the component mounted in the golf club 1B to a fitter or golfer (mainly a golfer) by means of the vibration. The vibration generating device 35B generates vibration in accordance with the state of the golf club 1B under the control of the CPU. For example, when the residual battery capacity has fallen below a predetermined threshold value, the CPU supplies electrical power to the vibration generating device 35B to cause the vibration generating device 35B to vibrate. A golfer holding the golf club 1B is made aware of the state of the golf club 1B by the vibration transmitted to the grip 13 or the like. Also, by changing the frequency of the vibration generated by the vibration generating device 35B or the vibration generation period to match the state of the golf club 1B, it is possible to enable the fitter or golfer to distinguish between different states of the golf club 1B.

As described above, in the golf club 1B of the second related art, the state of a component mounted in the golf club 1B is indicated to the golfer by vibration generated by the vibration generating device 35B. Also, there is no portion projecting from the grip end 14. Thereby, the same effect as the embodiment of the present invention is achieved even in the second related art.

Other Embodiments or Related Arts

Hereinabove, the embodiment of the present invention was described, but other embodiments are conceivable in the present invention, such as the following.

(1) In the golf club 1 of the embodiment of the present invention, the light emitted by the light emitting element 35 is guided to the grip end 14 using the optical fiber 36. However, the optical fiber 36 may be omitted to make the light emitted by the light emitting element 35 directly travel to through hole 17 of the cap 16. This is because in this mode, it is possible to visually confirm the light emitted by the light emitting element 35 in the grip 13 by looking in the grip 13 via the through hole 17. However, since it is possible to visually confirm more clearly the light emitted by the light emitting element 35 in the mode using the optical fiber 36, it is preferable to guide the light using the optical fiber 36.

(2) In the golf club 1 of the embodiment of the present invention, the cap 16, the grip end holder 18, and the grip 13 may be formed using a material having light transmittance, so as to make those portions be transparent or translucent. In this mode, even if the optical fiber 36 is omitted, it is possible to clearly perform visual confirmation of the light emitted by the light emitting element 35 from outside of the grip 13.

(3) In the golf club 1A of the first related art, the through hole 17 may also be provided in the cap 16. This is because the sound emitted from the sound emitting device 35A is easily transmitted to outside of the golf club 1A via the through hole 17, and so it becomes easy for the fitter or golfer to hear the sound. Also, in the golf club 1A of the first related art, the through hole 17 may be provided in the cap 16, and moreover a sound guiding tube may be provided from the sound emitting device 35A to the through hole 17 of the cap. In this mode, since the sound emitted from the sound emitting device 35A is guided to the grip end 14 to be emitted to outside of the grip 13 via the grip end 14, it is possible for the fitter or golfer to hear the sound more clearly.

(4) The indicating means is not limited to the mode exemplified in the embodiments. Also, by combining the embodiment and the first related art of the present invention, multiple types of indicating means may be mounted in the golf club in the manner of accommodating the light emitting element 35 and the sound emitting device 35A in the grip 13 of the golf club. By mounting multiple types of indicating means, it is possible to increase the types of states of the golf club that can be indicated. In addition, a first indicating means (for example, the light emitting element) may be disposed on the plate surface side of the first internal substrate 21 on which the main device 31 and the connector 32 are arranged, and a second indicating means (for example, the sound emitting device) may be disposed on the opposite side with respect to the position at which the first indicating means is arranged in a manner sandwiching the first internal substrate 21. By doing so, even if the space between the main device 31 and the connector 32 narrows, it is possible to provide a plurality of indicating means between the main device 31 and the connector 32.

(5) In swing measurement, the indicating means may also notify the golfer the fact that the golf club is in a state in which measurement preparation is complete. This is because the golfer, by ascertaining that the measurement preparation is complete, is able to begin his swing. Also, the indicating means of the golf club of the embodiment and related art described above may also perform a notification expressing a state of the golf club with an indication signal received from the computer serving as a trigger. For example, the CPU of the golf club that has received an indication signal from the computer, when the golf club at the time is in a state in which measurement preparation is complete, may cause the vibration generating device 35B to generate vibration, thereby notifying the golfer that the measurement preparation is complete. With this mode, by the fitter operating the computer to transmit the indication signal to the golf club, it is possible to prompt the golfer to perform a swing.

In the embodiment of the present invention described above, a device for detecting motion of the golfer (a motion detection device) is mounted in the interior of the grip 3 of the golf club. However, this kind of motion detection device is not limited to a device that detects the motion of a golfer. That is, by mounting this kind of device in the grip of a tennis racquet, a badminton racquet, a baseball bat and the like, it is possible to detect the motion of a tennis player, a badminton player, and a baseball player.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A golf club that is used in a fitting service that selects a golf club suited to a golfer and that has a shaft and a grip, comprising:

components mounted in the interior of the grip, including at least a sensor that detects motion of the golfer, a wireless module that modulates a signal output by the sensor, and an antenna that is connected to the wireless module; and a light emitting element that is mounted in the interior of the grip and that indicates the state of the components, wherein the antenna is provided at a position nearer to the grip end of the grip than the light emitting element, and an optical fiber is provided that propagates the emission light emitted from the light emitting element to the outside of the grip end.

2. The golf club according to claim 1, wherein the components mounted in the interior of the grip further include a battery that supplies electrical power to the sensor and the wireless module, and the light emitting elements indicates the charge state of the battery.

3. The golf club according to claim 1, wherein the light emitting element indicates the wireless connection state between the wireless module and an external computer.

4. The golf club according to claim 1, wherein the light emitting element indicates a disconnection state between components mounted in the interior of the grip.

5. The golf club according to claim 1, wherein a shaft end of a shaft inserted in the interior of the grip is positioned closer to the head than the grip end; and the antenna is disposed in a region between the shaft end and the grip end within the grip.

6. The golf club according to claim 5, wherein a connector that is an interface for connecting an external device, the light emitting element, and the sensor are disposed in that order in the direction leading from the shaft end to the head at the region in the interior of the shaft that is in the interior of the grip.

7. A motion detection device that is provided in a grip and that detects motion of a player, comprising:

components mounted in the interior of the grip, including at least a sensor that detects motion of the player, a wireless module that modulates a signal output by the sensor, and an antenna that is connected to the wireless module; and a light emitting element that is mounted in the interior of the grip and that indicates the state of the components, wherein the antenna is provided at a position nearer to the grip end of the grip than the light emitting element, and an optical fiber is provided that propagates the emission light emitted from the light emitting element to the outside of the grip end.

* * * * *